United States Patent [19]

Smith

[11] Patent Number: 4,615,132

[45] Date of Patent: Oct. 7, 1986

[54] SELF LOADING PISTOL HAVING A REAR SIGHT WHICH SECURES A DETACHABLE BREECH BLOCK INSERT

[76] Inventor: David E. Smith, 5 Park Ave., Telscombe Cliffs, Sussex, England

[21] Appl. No.: 593,390

[22] Filed: Mar. 26, 1984

[30] Foreign Application Priority Data

Mar. 28, 1983 [GB] United Kingdom ..... 8308422

[51] Int. Cl.[4] ..... F41C 15/06; F41C 11/00

[52] U.S. Cl. ..... 42/25; 42/100; 42/75.01

[58] Field of Search ..... 42/25, 75 A–75 C, 42/16, 1.5

[56] References Cited

U.S. PATENT DOCUMENTS 985,847 3/1911 Searle ..... 42/25
2,145,328 1/1939 Walther ..... 42/25
2,465,553 3/1949 Robinson, Jr. ..... 42/25
3,696,542 10/1972 Ekfeldt et al. ..... 42/25
3,728,939 4/1973 Wilhelm ..... 42/75 A
4,457,092 7/1984 Hupp et al. ..... 42/25

*Primary Examiner*—Deborah L. Kyle
*Assistant Examiner*—Michael J. Carone
*Attorney, Agent, or Firm*—Harness, Dickey & Pierce

[57] ABSTRACT

In a fire arm of the self loading pistol type having a reciprocating breech block slide (B) with a detachable breech block insert (F) holding a cartridge extractor (M) and a firing pin (S), the insert (F) is held in position in the slide (B) by means of the rear sight (N) of the fire arm. The rear sight is of bifurcated construction, the two limbs locating in respective vertical slots in the sides of the insert (E) and the top in a transverse slot in the slide (B). One limb (N3) of the bifurcation may contain screw means for adjusting the height of the rear sight, such adjusting means thereby being protected against damage and dirt.

7 Claims, 32 Drawing Figures

B2
M
B
B7
B
M3
N3
N2
N
B5
B4

F1
F3
F4
F8
F2
F
F6
F5

F1
F7
F2
F
F3
F4
F8

F10
F5
F11
F12

F5
F9
F12

F1
F
F8
F2
F10
F12
F9
F7

A2
A9
L5
J
A2
A
L
A9
L1

B5
M1
M
F11
F10
F5
B4
B2
B25
L1
M3
AC

M1
M4
M2
M
M3

M1
M2
M
M4
M3

S2
S4
S
S1

S2
S1

N2
N3
N
N3

N2
N
N3
N1

AC
AC1
AC2

PP5
PP4
PP

PP1

PP
PP3
PP5
PP4
A
A
PP2

QQ2
QQ
QQ1

R
P
A9
A2
B8
QQ2
PP4
QQ3
B2
B26
QQ1
PP
PP
PP5

SELF LOADING PISTOL HAVING A REAR SIGHT WHICH SECURES A DETACHABLE BREECH BLOCK INSERT

This invention relates to fire arms of the self loading pistol type, in which a reciprocating breech block slide is employed, with detachable breech block insert holding a cartridge extractor and firing pin. It is an object of the invention to provide a simple method of securing such an insert in the slide.

The usual practice in self loading pistols is to have a rear sight carried in a lateral dovetail cut in the slide upper surface, if an adjustable rear sight is required the existing slide dovetail is utilised to mount the adjustable sight.

The disadvantage of the aforesaid practice is that the adjustable rear sight mounted by any means on the top of the slide is prone to damage by knocks which can alter the alignment of the sight; also any adjusting mechanism is exposed to damage and dirt.

Greater convenience would be provided by an adjustable rear sight being contained within the maximum section of the slide with the vertical adjusting mechanism not exposed on the outer surface of the pistol, and it is a further object of the invention to provide such a more convenient construction when an adjustable rear sight is used.

It is another object of the invention to provide for self loading pistols or other fire arms, a breech insert with cartridge extractor, spring for said extractor, firing pin, spring for said firing pin, and if required, a cartridge conversion clip, the whole dismountable without specialised tools on removal of the rear sight.

It is another object of the invention to provide for self loading pistols or other fire arms an easily alterable mechanism that would allow cartridges of varying case base diameters to be used in a pistol or other fire arm without having to use more than a single breech block unit or slide.

It is a further object of the invention to provide a vertically adjustable rear sight and a breech insert for a self loading pistol or other fire arm that is of simple construction and cheap to manufacture.

According to the invention, there is provided a fire arm of the self loading pistol type, comprising a reciprocating breech block slide having a detachable breech block insert, holding a cartridge extractor and a firing pin, and a rear sight, wherein the breech block insert is held in position in the slide by means of the rear sight.

In order to allow the insert to be used with cartridges of smaller diameter, in accordance with a further feature of the invention, the insert is provided with means for raising the axis of a cartridge before it is chambered in the barrel, and for supporting the cartridge rim during extraction, so that said cartridge rim can be gripped by said extractor.

An embodiment of the invention is shown in the drawings and will be described in detail hereinafter. The same letters of reference indicate corresponding parts in the several figures of the drawings.

FIG. 1 of the accompanying drawings represents, partly in elevation and partly in longitudinal vertical section, a self loading semi-automatic pistol provided with means constructed and arranged in accordance with this invention for providing such a pistol with a breech block insert which incorporates a cartridge extractor, firing pin, related springs, and, if required, cartridge conversion clip, the whole secured in the breech slide by a rear sight unit; this view shows the slide in forward battery position, barrel chamber loaded with a cartridge, hammer uncocked;

In the self loading pistol represented in FIG. 1 the slide B contains a longitudinal circular pocket in the rear section, into which the breech block insert F, hereinafter termed the insert, is inserted from the breech face B2 of the slide, and abuts against a solid transverse surface B3 at the rear of the slide.

The insert is of the form shown in FIGS. 9 to 13 inclusive, and will hereinafter be further described. The insert has a rebate along the majority of its outer surface, leaving a short bearing surface at the front F1 and at the rear F2, the rebate being provided to accommodate a cartridge conversion clip AC, and prevent friction and binding when inserting or removing the insert. In the upper surface of the insert is a longitudinal slot F3 with a hole F4 in the curved rear end; the hole is angled towards the rear of the insert, but does not penetrate through to the longitudinal hole F5, which holds the firing pin S and the firing pin spring MM. In the slot F3 is placed the extractor M with the extractor spring NN bearing against the extractor tail M1, the spring locating in hole F4. The extractor pivot pin M2 seats in a semi-circular groove F6 cut transversely across the top of the insert where the slot F3 is located. When the insert is in the slide pocket the extractor upper sides locate in a longitudinal slot B5 in the slide top centre above the breech face, the slot being accommodated in a shallow concave longitudinal flute B4 as shown in FIGS. 15, 1, 2, 6, and 8.

Figures 1, 2, 3, 4, 5, 6, 7:
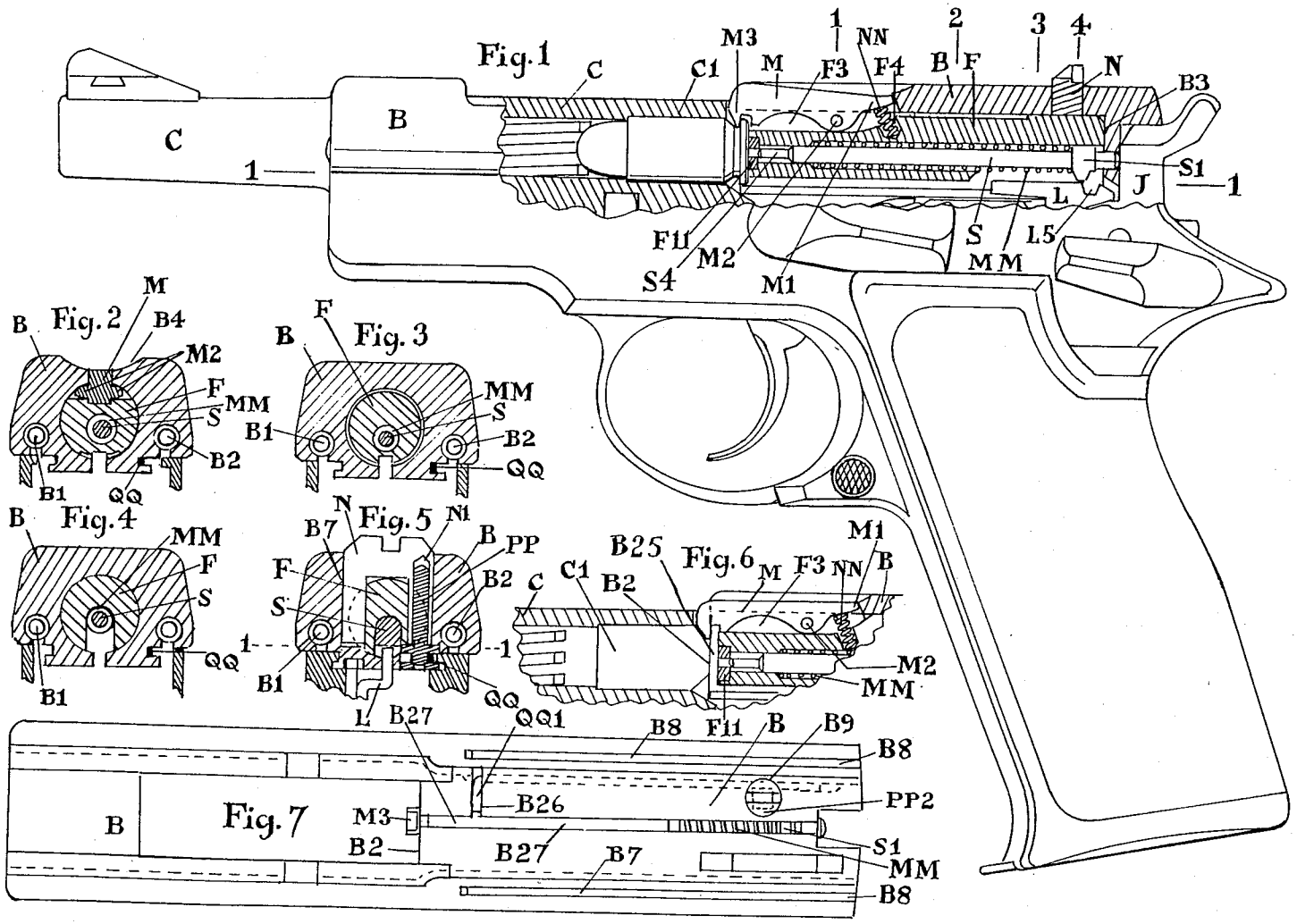
FIG. 2 is a transverse vertical section of FIG. 1 upon the line 1.
FIG. 3 is a transverse vertical section of FIG. 1 upon the line 2.
FIG. 4 is a transverse vertical section of FIG. 1 upon the line 3.
FIG. 5 is a transverse vertical section of FIG. 1 upon the line 4.
FIG. 6 is a partial vertical longitudinal section upon the centre line of the breech area of FIG. 1, with the barrel chamber empty.
FIG. 7 is a plan view of the slide base with the whole breech block insert unit and rear sight unit fitted in the slide.
Figures 8, 9, 10, 11, 12, 13, 14, 15, 16, 17, 18, 19, 20, 21, 22, 23, 24, 25, 26, 27:
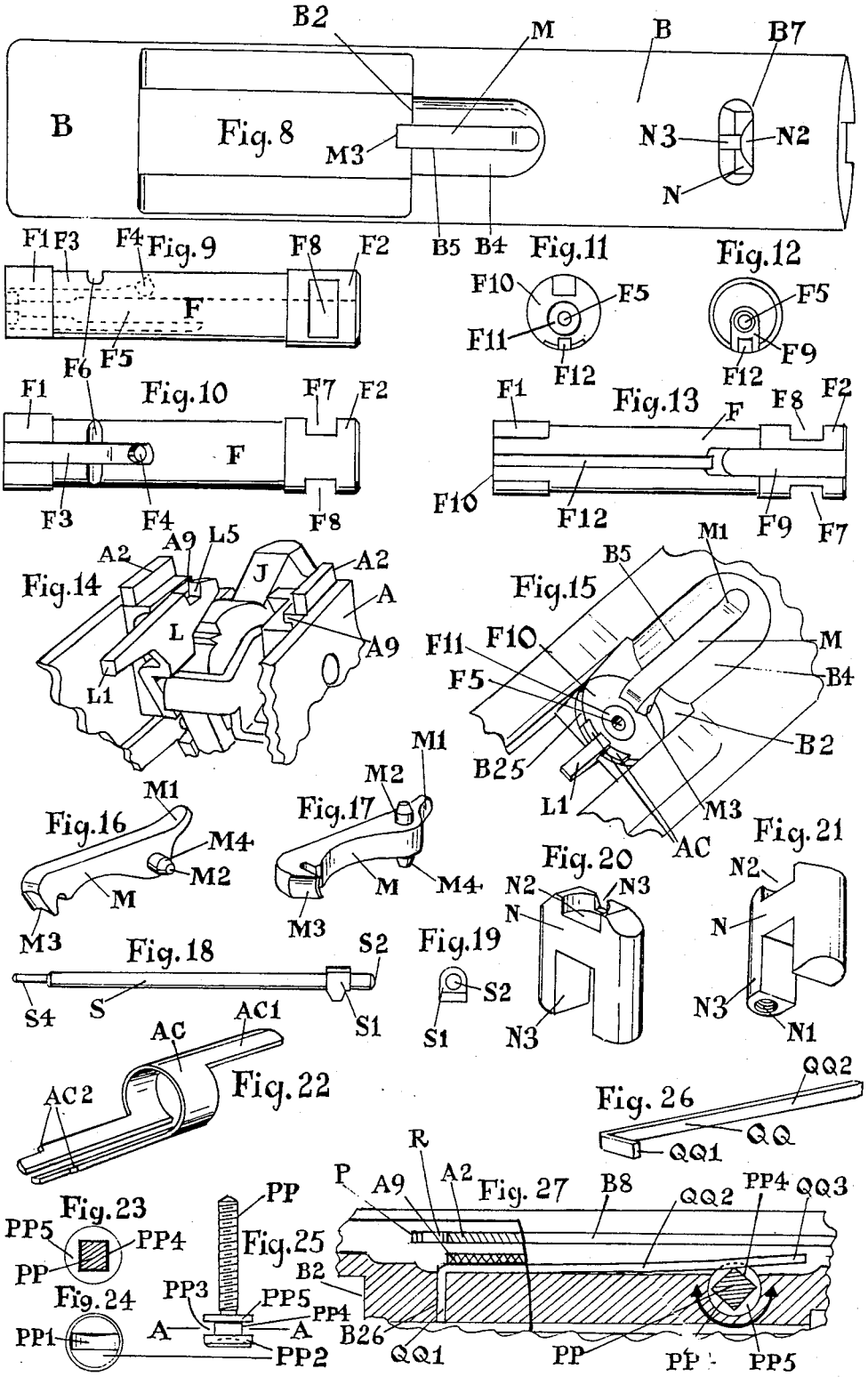
FIG. 8 is a plan view of the slide top with breech insert and rear sight fitted.
FIG. 9 is a left side elevation of the breech block insert.
FIG. 10 is a plan view of the breech block insert top.
FIG. 11 is a front elevation of the breech block insert.
FIG. 12 is a rear elevation of the breech block insert.
FIG. 13 is a plan view of the breech block insert base.
FIG. 14 is a perspective view of the illustrated pistol, showing the upper rear frame with a firing lock adapted for the breech block insert and slide herein described.
FIG. 15 is a perspective view of the forward breech area of the slide, with a complete breech block inset fitted, viewed from the front above the slide.
FIG. 16 is a perspective view of the extractor.
FIG. 17 is a further perspective view of the extractor.
FIG. 18 is a left side elevation of the firing pin.
FIG. 19 is a rear elevation of the firing pin.
FIG. 20 is a perspective view of the sight body.
FIG. 21 is a further perspective view of the sight body.
FIG. 22 is a perspective view of the cartridge conversion clip.
FIG. 23 is a transverse section view along line A—A of FIG. 25 of the rear sight adjusting and retaining screw.
FIG. 24 is an end view of the rear sight adjusting and retaining screw.
FIG. 25 is a side elevation of the rear sight adjusting and retaining screw.
FIG. 26 is a perspective view of the rear sight spring.
FIG. 27 is a longitudinal transverse section along line 1—1 in FIG. 1 of the rear slide between the breech face and the rear of the slide, viewed from below, the bold outline indicating the position of the frame rear when the slide is locked to the rear with the hold open catch.
Figure 28:
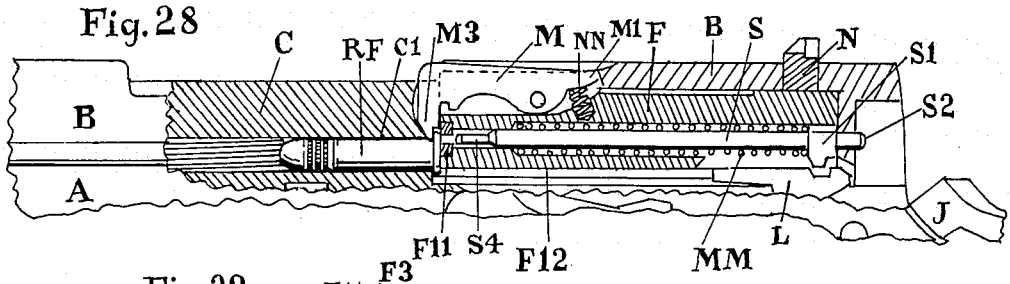
FIG. 28 is a longitudinal vertical section view of the breech area showing the adaption of the breech block insert for use with small calibre rimfire ammunition.

FIG. 1 shows the position of the extractor with the chamber C1 of the barrel C loaded. The extractor nose M3 is hooked in the cartridge extractor groove, raising the front of the extractor to where its front upper section is above the lower surface of the flute B4 but not proud of the upper surface of the slide. The raised portion of the extractor can be felt or seen lifted in the slide flute when a cartridge is chambered in the barrel and thus acts as a loaded chamber indicator. FIGS. 6 and 15 show the extractor position with an empty barrel chamber, and will be seen not to protrude into the slide flute, thereby acting as an empty chamber indicator.

The firing pin hole F5 has its maximum diameter extended downwards vertically as a cutout slot F9 which will accommodate the firing pin boss S1 as shown in FIGS. 18, and 19, the boss having flat parallel sides to seat in slot F9 and prevent rotation of the firing pin, and the base of the boss is formed into a tooth with a flat base, tapered downwards front and rear. The tooth will be engaged by the notch L5 in the ejector L during a hammer decocking action as incorporated in the pistol illustrated, but not forming part of this invention. A firing pin without such a boss shown could be fitted to the insert herein described, merely having a suitable flange to act upon the firing pin spring, and contained in a simple longitudinal circular hole.

The breech face F10 of the insert has a bush F11 fitted with a central longitudinal hole to allow passage of the firing pin nose S4.

Figure 29:
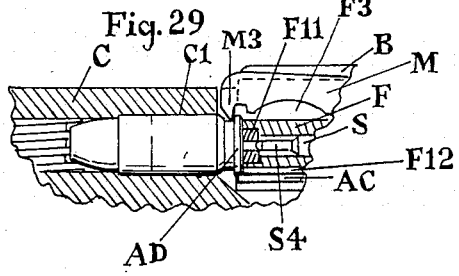
FIG. 29 is a longitudinal vertical sectional view of the breech area with the cartridge conversion clip fitted and a smaller diameter cartridge chambered in the barrel than that in FIG. 1.

The cartridge conversion clip AC, shown in FIG. 22, is fitted or removed with the insert removed from the slide pocket. The clip is sprung round the insert rebated section, the tongue AC1 seated on the rear top of the insert abutting the front edge of surface F2. The two forward tongues traverse recesses along each side of the ejector passage slot F12 in the insert, the steps AC2 seating against the rear edge of surface F1. FIG. 29 shows the use of the clip, the rim of the cartridge case AD being supported at its lower periphery by the upper surfaces of the protruding ends of the two clip tongues. FIG. 15 shows the protrusion of the clip tongue ends. The action of the conversion clip tongue ends will raise the cartridge axis when the cartridge case is not chambered in the barrel, and support the same cartridge case rim during the extraction sequence, preventing the case being forced down by the extractor and possibly being forced from out of the confines of the recess B25 during extraction and causing an obstruction in the action.

When the insert is put into the slide pocket the extractor M locates in the slide slot B5, the extractor pivot pins M2 locate in the insert groove F6, and the chamfer M4 on the pivot pins will bear against the upper inner peripheral surface of the slide pocket, as shown in FIG. 2.

Figure 31:
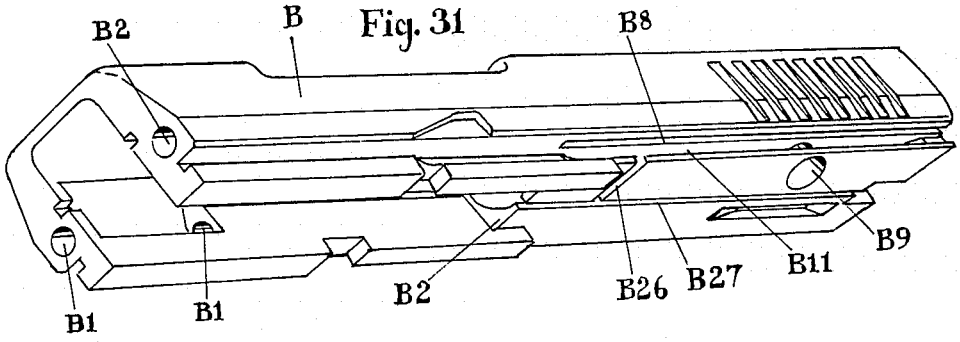
FIG. 31 is a perspective view of the slide, viewed from front lower left.
Figure 32:
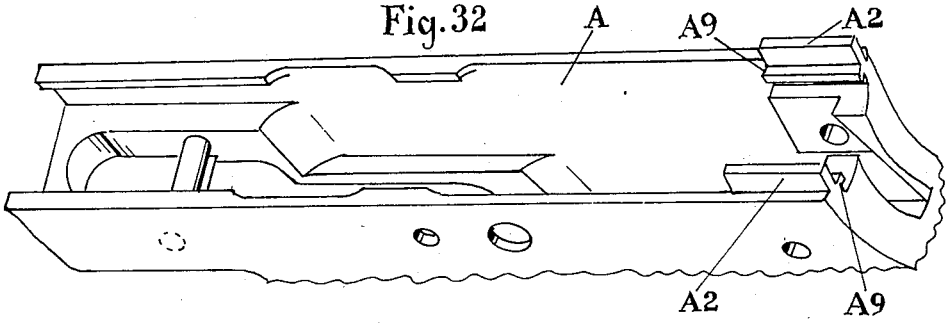
FIG. 32 is a perspective view of the frame, viewed from left above.

When the insert is in the slide pocket the square section vertical slots F7 and F8 in the insert rear section will align with the transverse slot B7 which passes vertically through the slide rear terminating on the plane shown in FIG. 5 by the dotted line 1. to 1. The slot has rounded ends as shown in FIG. 8. The rear sight N, as shown in FIGS. 20 and 21, is a bifurcated block with semi-circular section sides which correspond with the rounded sides of slot B7. One bifurcation N3 has a blind vertical threaded hole N1. The rear sight top has bevelled sides and a semi-circular horizontal cut out N2; the solid section to the front of the slide top has a square section notch cut N3 in it, as shown in FIG. 8 and FIG. 20. The rear sight is inserted into the slot B7 and the bifurcations will traverse down the slots F7 and F8 in the insert. The rear sight is inserted into the slide with the cut out N2 facing to the rear of the slide. The rear sight screw PP is inserted into the base of the slide through hole B9 and is screwed into hole N1 in the limb N3. The sight screw is rotated by a suitable implement applied to slot PP1 and screwed into the sight limb until the screw base PP2 is seated in the hole B9 and flush with the slide under surface. The rear sight spring QQ is placed in slide groove B11 with the limb QQ1 located in the transverse slide slot B26. The longer limb QQ2 will at the rear pass partly through hole B9, and at a right angle to the axis of the rear sight screw pass through the slot PP3 cut around the base PP2. The transverse section view of the rear sight screw body in FIG. 23 shows the square section where the slot PP3 is cut, the spring limb QQ2 will rest along one of the four flats PP4 and obstruct the flange PP5 from moving down out of hole B9. When the spring limb is deflected during rotation of the sight screw, as in FIG. 27, the limb will not be deflected completely out of slot PP5, thereby still retaining the sight screw during adjustment of the rear sight height. The frame guide A9, shown as a hatched line section in FIG. 27 traverses slide groove B11 during the slide recoil cycle and is always adjacent to the spring limb QQ3, on full recoil as shown in FIG. 27, and with the slide at rest adjacent to limb extremity QQ3. Therefore the rear sight spring can only be removed from its location when the slide is fully off the frame. The rear sight can only be adjusted with the slide locked to the rear as sownn in FIG. 27. FIGS. 31 and 32 show the relation of the guides and grooves on the slide and frame, the frame lower surface with the ejector slot B27 and rear sight screw hole B9. Frame lugs A2 travel in slide slots B7 and B8 to compress recoil springs guides R at the rear of recoil springs P, the springs and guides travelling in slide tunnels B1 and B2.

FIG. 15 shows the slide at full rearward position with the ejector nose L1 protruding clear of the breech face, with the two forward limb tongues in position, as in FIG. 29 but with not cartridge case.

The removal of the rear sight and insert are effected by reversing the afore mentioned procedures.

Figure 30:
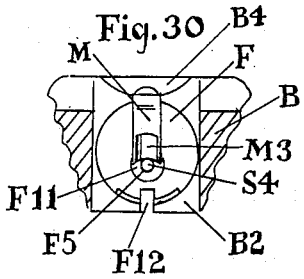
FIG. 30 is a front elevation view of the breech face showing the adaption for rimfire small calibre ammunition

When the use of small calibre rimfire ammunition is required in a pistol or fire arm with a breech insert as herinbefore described a suitable barrel should be fitted with the bore axis in a line below that of the insert firing pin axis and the rim of the chambered rimfire cartridge in a position immediately before the central hole in the insert bush B11, to allow the firing pin nose to impinge on said rim on the impact of the rotating hammer J on the base S2 of the firing pin. An downward extended nose extractor will be fitted to the insert as shown in FIG. 30, the hook M3 low enough to engage the rim of the chambered cartridge RF. The normal ejector will eject the rimfire cartridge when used with the insert here before described.

The breech block insert could be fabricated from a number of materials such as a light alloy, plastic, or heavy metal, thereby being used as a means of regulating the weight and inertia of the slide.

The application of the invention to other small arms differs in no essential respect from its application to pistols of the type hereinbefore described.

The terms "horizontal" and "vertical" as used herein refer to the pistol or other fire arm when held in the normal firing position.

I claim:

1. A fire arm of the self loading pistol type, comprising a barrel, a reciprocating breeck block slide having a detachable breach block insert, said insert holding a cartridge extractor and a firing pin, a chamber to hold a cartridge having a rim, a firing lock and a rear sight, wherein the breach block insert is held in position in the slide by means of the rear sight, wherein the rear sight has a lower point which is of bifurcated construction to provide two limbs that are located in respective vertical slots that are provided in opposite sides of the insert, and an upper part that is located in a transverse slot in the slide, and wherein one limb of the bifurcation has provided at its lower end a blind, vertical, internally-threaded bore, into which an adjusting screw for the rear sight is is threadedly inserted, the screw having a lower portion which projects into a hole in the slide and can be rotated through said hole to adjust the position of the rear sight, means being provided to prevent relative axial movement of said screw with respect to said slide.

2. A fire arm as claimed in claim 1, wherein said transverse slot has rounded ends and said sight has rounded edges mating with the rounded ends of said transverse slot.

3. A fire arm as claimed in claim 4, wherein said means comprises an annular groove in the lower portion of said screw and a spring arm bearing against a wall of said groove.

4. A fire arm as claimed in claim 1, wherein said insert and said slide have respective tops and wherein said cartridge extractor is located in a longitudinal slot defined by walls in the top of said insert and a mating slot in a flute in the top of said slide, said extractor being pivotally mounted in said slot in such manner that its upper edge only projects above the walls of said slot into said flute when the extractor is gripping the rim of a cartidge in the chamber of the fire arm, thereby providing a visual and tactile indication of the presence of a cartridge in the chamber.

5. A fire arm as claimed in claim 4, wherein said extractor is spring loaded to bring its nose into gripping contact with a cartridge rim by a spring located in a blind hole in said insert, said hole opening into the slot in the insert in which said extractor is located.

6. A fire arm as claimed in claim 1, wherein, in order to allow said insert to be used with cartridges of small diameter, the insert is provided with means for raising the axis of a cartridge before it is chambered in the barrel, and for supporting the cartridge rim during extraction, so that said cartridge rim can be gripped by said extractor.

7. A fire arm as claimed in claim 6, wherein the insert has a lower side provided with a slot therein and a forward end, and wherein said means comprises a resilient clip adapted to surround a rebated central portion of said insert, said clip having two forward tongues extending in recesses on either side of the slot in the lower side of said insert for the passage of an ejector forming part of of the firing lock of the fire arm, said tongues extending beyond the forward end of said insert and serving to support the rim of a cartridge of reduced diameter.

* * * * *